US011406863B2

(12) United States Patent
Bonyai

(10) Patent No.: US 11,406,863 B2
(45) Date of Patent: Aug. 9, 2022

(54) WEBBING LOOP WITH SLEEVE FOR EXERCISES

(71) Applicant: Fit the Industry LLC, Norwalk, CT (US)

(72) Inventor: Joseph J. Bonyai, Norwalk, CT (US)

(73) Assignee: FIT THE INDUSTRY LLC, Norwalk, CT (US)

( * ) Notice: Subject to any disclaimer, the term of this patent is extended or adjusted under 35 U.S.C. 154(b) by 0 days.

(21) Appl. No.: 16/826,763

(22) Filed: Mar. 23, 2020

(65) Prior Publication Data

US 2020/0306581 A1 Oct. 1, 2020

Related U.S. Application Data

(60) Provisional application No. 62/825,456, filed on Mar. 28, 2019.

(51) Int. Cl.

| | |
|---|---|
| ***A63B 23/04*** | (2006.01) |
| ***A63B 21/16*** | (2006.01) |
| ***A63B 21/00*** | (2006.01) |

(52) U.S. Cl.

CPC ..... *A63B 21/4017* (2015.10); *A63B 21/151* (2013.01); *A63B 21/16* (2013.01); *A63B 23/0405* (2013.01); *A63B 2023/0411* (2013.01)

(58) Field of Classification Search

CPC ..... A63B 21/02; A63B 21/028; A63B 21/04; A63B 21/0442; A63B 21/055; A63B 21/0552; A63B 21/0555; A63B 21/0557; A63B 21/151; A63B 21/16; A63B 21/4005; A63B 21/4007; A63B 21/4009; A63B 21/4011; A63B 21/4013; A63B 21/4015; A63B 21/4017; A63B 21/4019; A63B 21/4021; A63B 21/4025; A63B 21/4027; A63B 21/4033; A63B 21/4035; A63B 21/4043

See application file for complete search history.

(56) References Cited

U.S. PATENT DOCUMENTS 5,545,113 A * 8/1996 Bobich ..... A63B 21/0004 482/124
5,921,903 A * 7/1999 Lawrence ..... A63B 23/0211 482/140

(Continued)

OTHER PUBLICATIONS https://physicalindustries.com/ Accessed May 27, 2021.

*Primary Examiner* — Nyca T Nguyen
*Assistant Examiner* — Zachary T Moore
(74) *Attorney, Agent, or Firm* — Murtha Cullina LLP

(57) ABSTRACT

A cable attachment that accommodates fundamental movement patterns of a user. The cable attachment includes a structural connector with a mounting aperture, a sleeve forming a first aperture at one end and a second aperture at an opposite second end and a webbing loop. The webbing loop having a webbing fabric with opposing first and second surfaces extending from a sewn end to a sleeve end. The webbing fabric is fixed to itself proximate the aperture for a sewn length. At the opposite end of the webbing fabric it is fixed to the second aperture of the sleeve. The sleeve surrounds the webbing fabric and slides along the webbing fabric to allow adjustment of the length of the webbing fabric to accommodate the fundamental movement patterns of the user.

11 Claims, 5 Drawing Sheets

(56) References Cited

U.S. PATENT DOCUMENTS

| | | | | |
|---|---|---|---|---|
| 6,036,626 | A * | 3/2000 | Taylor | A63B 21/0004 482/121 |
| 6,216,319 | B1 * | 4/2001 | Elkins | A45F 5/00 224/221 |
| 7,662,073 | B1 * | 2/2010 | Baldwin | A63B 21/4021 482/92 |
| 8,083,653 | B2 * | 12/2011 | Hetrick | A63B 21/1663 482/91 |
| 9,155,931 | B2 * | 10/2015 | Hetrick | A63B 21/0555 |
| 9,339,086 | B2 * | 5/2016 | Hill | A44B 11/04 |
| 9,635,925 | B2 * | 5/2017 | Moreau | F16B 45/00 |
| 2003/0148861 | A1 * | 8/2003 | McBride | A63B 21/4019 482/92 |
| 2011/0028229 | A1 * | 2/2011 | Oh | A63B 53/14 473/205 |
| 2016/0361582 | A1 * | 12/2016 | Zbinden | A63B 21/068 |
| 2021/0101045 | A1 * | 4/2021 | Stone | A63B 23/12 |

* cited by examiner

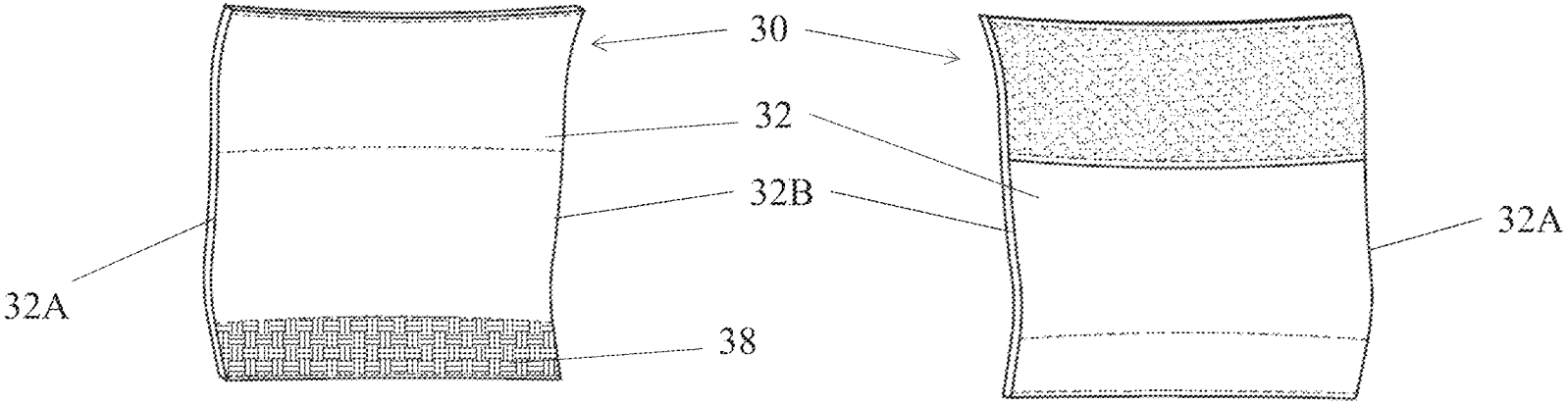
FIG. 3A
FIG. 3B
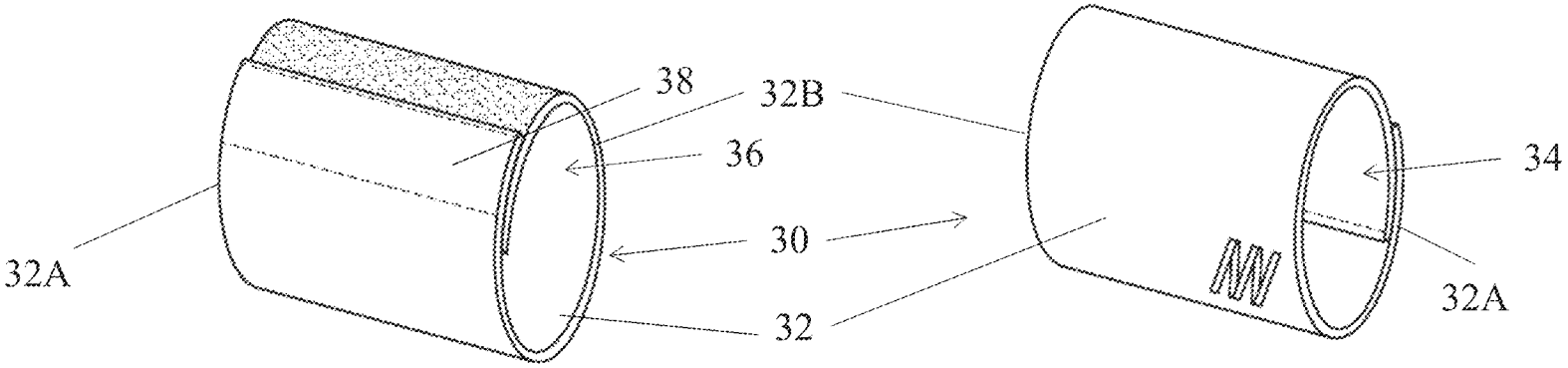
FIG. 3C
FIG. 3D

WEBBING LOOP WITH SLEEVE FOR EXERCISES

CROSS REFERENCE TO RELATED APPLICATIONS

This application claims the benefit of U.S. Provisional Patent Application Ser. No. 62/825,456 filed on Mar. 28, 2019, which is incorporated herein by reference in its entirety.

TECHNICAL FIELD

The invention relates to a cable attachment for exercises, and specifically to a cable attachment having a webbing loop with a sleeve for cable and bungee exercises.

BACKGROUND

Generally, ground based sports skills such as swinging, throwing and changing direction are performed through a combination of fundamental movement patterns including squatting, lunging and rotation through the hips and trunk. The aforementioned movements are difficult to simulate and load with traditional strength training exercise equipment. Traditional machine and free weight exercises mostly require movement in one plane of motion.

There are limited pieces of exercise equipment designed to resist total body rotational and lateral movement, as is necessary in many ground-based sports such as baseball, basketball, track and field events and the like. Present devices that attempt to accommodate these types of movements apply primarily total body rotational or lateral resistance and are not adjustable.

As a result, there exists a need in the art for a device that accommodates fundamental movement patterns of the user.

SUMMARY

There is disclosed herein a cable attachment that accommodates fundamental movement patterns of a user. The cable attachment has a structural connector, a sleeve and a webbing loop. The structural connector defines a mounting aperture. A sleeve is formed by a single section of a material, wrapped around and fastened to itself and forming a first aperture at a first end and a second aperture at an opposite second end. The webbing loop is a webbing fabric that has opposite first and second surfaces. Both the first and second surfaces of the webbing fabric extend from a sewn end to a sleeve end. A proximal tip of the sewn end extends through the mounting aperture in the structural connector. The second surface of the webbing fabric is fixed to itself, proximate to the aperture for a sewn length extending from the structural connector to the proximal tip. The webbing fabric also has a padding fixed to the second surface between the sewn end and the sleeve end and the webbing fabric terminates at a distal tip of the sleeve end. The distal tip of the webbing fabric is fixed to the second aperture of the sleeve. The sleeve surrounds the webbing fabric between the padding and the seam end. The sleeve slides along the webbing fabric to allow adjustment of the length of the webbing fabric to a desired length for the fundamental movement patterns of the user.

In one embodiment, the sleeve automatically slides along the webbing fabric to a secured length during a securing period and the user manually slides the sleeve along the webbing fabric to the desired length during a preparation period.

In one embodiment, friction between the sleeve and the webbing fabric maintains the desired length during an operation period when the user performs the fundamental movement patterns.

In one embodiment, the desired length is longer than the secured length.

In one embodiment, the cable attachment provides a resistance force the prevents the fundamental movement patterns of the user. The fundamental movement patterns of the user are rotational movements and/or lateral movements.

In one embodiment, the mounting aperture of the structural connector attaches to a fixed structure.

In one embodiment, the fundamental movement pattern of the user is movement in more than one plane of motion.

In one embodiment, the fundamental movement pattern of the user is squatting, lunging, rotation through the hips of the user and/or rotation through the trunk of the user.

There is also disclosed herein a method of accommodating fundamental movement patterns of a user. The method includes providing a cable attachment having a structural connector defining a mounting aperture, a sleeve forming a first aperture and a second aperture opposite the first aperture and a webbing loop reaching through the mounting aperture and fixing to itself at a sewn end and fixing to the second aperture at an opposite sleeve end. The method includes attaching the mounting aperture of the structural connector to a structure. The structure provides an external resistance to movement. The method then includes lengthening the webbing loop fully with the user facing away from the structure. The user then places an arm into a portion of the webbing loop having a U-shaped cross-section. The method includes the user then rotating in a direction away from the cable attachment. Finally, the method includes performing fundamental movement patterns with the arm of the user in the portion of the webbing loop. The fundamental movement patterns include swinging, throwing, squatting and/or lunging.

In one embodiment, the method also includes sliding the sleeve along the webbing loop away from the structural connector before or after the step of performing fundamental movement patterns.

In one embodiment of the method, the sleeve engages the webbing loop after sliding along the sleeve to a desired length of the webbing loop.

In one embodiment of the method, the sleeve automatically slides along the webbing loop towards the user during the step of rotating the user in a direction away from the cable attachment.

In one embodiment of the method, the sleeve engages the webbing loop after automatically sliding along the sleeve to a secured length of the sleeve.

In one embodiment, a padding is fixed to the portion of the webbing loop surrounding the arm of the user.

BRIEF DESCRIPTION OF THE DRAWINGS

FIG. 3A is a top view of a sleeve of the cable attachment of FIG. 1 before fixing to itself;

FIG. 3B is a bottom view of the sleeve of FIG. 3A;

FIG. 3C is an isometric view of the sleeve of FIG. 3A after it is fixed to itself;

FIG. 3D is an isometric view of the sleeve of FIG. 3C;

DETAILED DESCRIPTION

Figure 1:
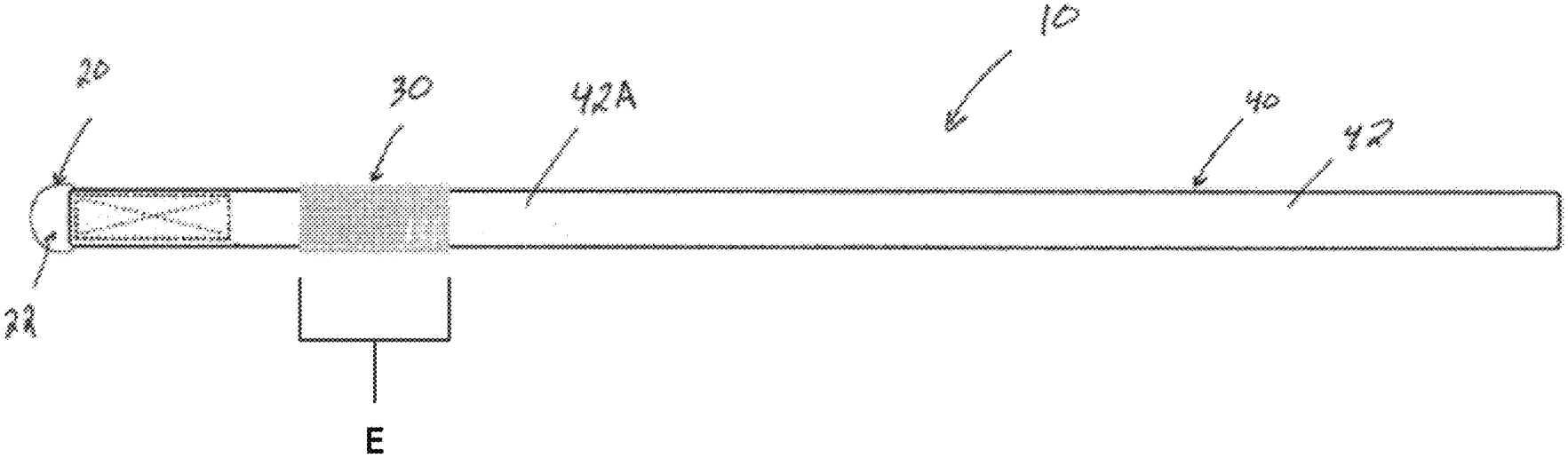
FIG. 1 is a top view of a cable attachment according to the present disclosure.

Referring to FIG. 1, a cable attachment generally denoted by the number 10, provides an adjustable band compatible with user exercises that require fundamental movement patterns. The cable attachment 10 has a structural connector 20, a sleeve 30 and a webbing loop 40.

Figure 4:
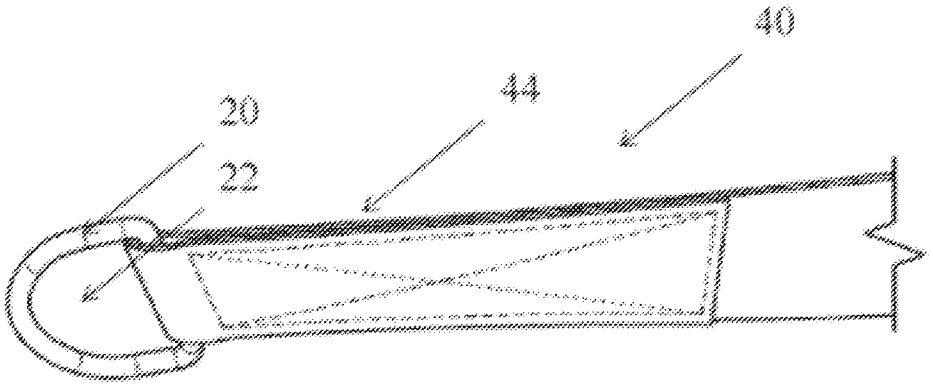
FIG. 4 is an isometric view of a structural connector of the cable attachment of FIG. 1.

Referring to FIGS. 1 and 4, the structural connector 20 defines a mounting aperture 22. The mounting aperture 22 of the structural connector 20 attaches to a fixed structure (not depicted). In the embodiment depicted in FIG. 4, the structural connector 20 is defined by a D-shaped cross-section having a width of approximately two inches and the structural connector 20 is made of a metallic heavy wire (i.e., steel, stainless steel, other plated metals, etc.). Other materials having sufficient strength or satisfying other requirements depending on the application do not depart form the invention disclosed herein. In other embodiments, the structural connector 20 has a width of between one and four inches.

Referring to FIGS. 3A-3D, the sleeve 30 is formed by a single section of a material 32, wrapped around and fastened to itself. In the embodiment depicted in FIGS. 3A-3D, the sleeve 30 is fastened to itself using complementary hook-and-loop type fasteners along bead 38 from a first end 32A of the section of material 32 to a second end 32B of the second of material 32. Other attachment means for securing the sleeve 30 to itself, including glue, staples, sewing, other fasteners, etc. do not depart from the invention disclosed herein. Other embodiments omit the bead 38 and the attachment means are disposed on the section of material 32 as necessary. The single section of material 32 fastened to itself in this manner forms a first aperture 34 proximate to the first end 32A and a second aperture 36 proximate to the second end 32B. In the embodiment depicted in FIGS. 3A-3D, the section of material 32 is made from a synthetic rubber such as neoprene and the section of material 32 is sixteen inches long and two inches wide (note: width is measured from the first end 32A to the second end 32B). In some embodiments, the section of material 32 is between ten and twenty-two inches long and is between one and three inches wide. Sections of material 32 made from other flexible materials providing sufficient friction do not depart from the invention disclosed herein. In some embodiments, the section of material 32 is preformed into a cylinder or other suitable cross-sectional shape prior to fixing to itself.

Figure 2:
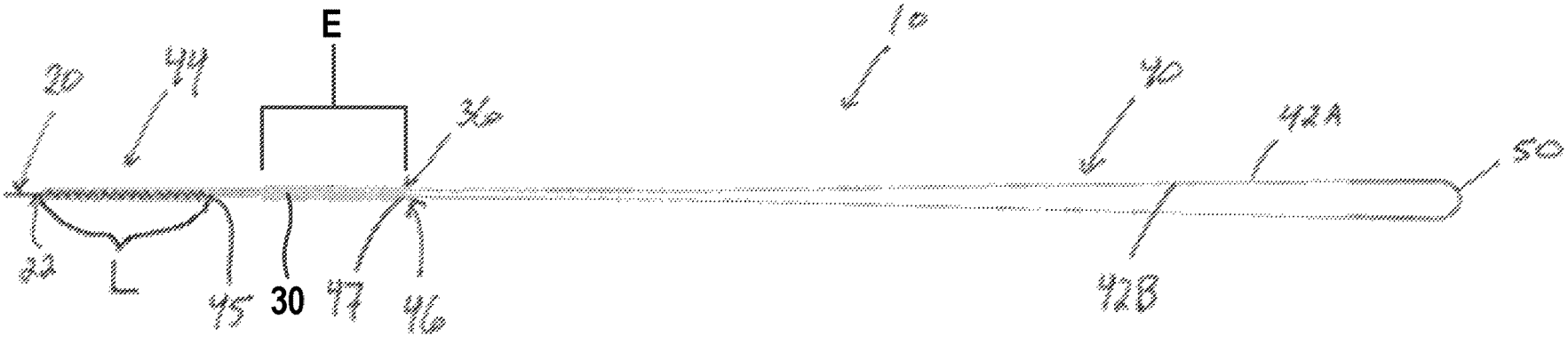
FIG. 2 is a side view of the cable attachment of FIG. 1.
Figure 5:
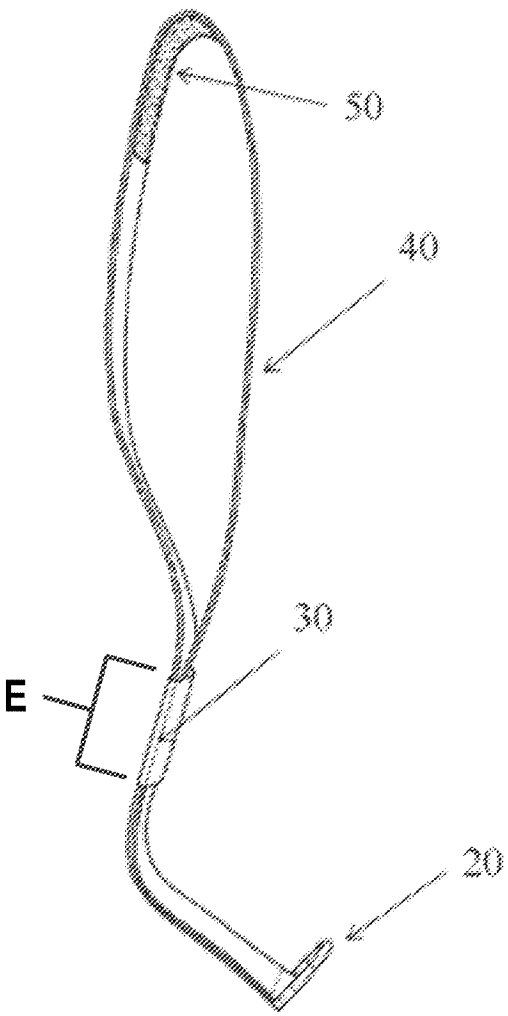
FIG. 5 is an isometric view of a padding of the cable attachment of FIG. 1.

Referring to FIGS. 1 and 2, the webbing loop 40 includes a webbing fabric 42 that has a first surface 42A and a second surface 42B opposite the first surface 42A. The webbing fabric 42 is made of a nylon webbing material and is two inches wide and one hundred and twenty inches long. Referring to FIG. 2, the length of the assembled webbing loop 40 and structural connector 20 is fifty-six inches. In some embodiments, the webbing fabric 42 is between one and four inches wide and is between one hundred and two hundred inches long. Webbing fabric 42 being made from other materials with acceptable resiliency, flexibility and strength do not depart from the invention disclosed herein. Both the first surface 42A and the second surface 42B of the webbing fabric 42 extend from a sewn end 44 to a sleeve end 46. A proximal tip 45 of the sewn end 44 extends through the mounting aperture 22 in the structural connector 20. The second surface 42B of the webbing fabric 42 is fixed to itself proximate the mounting aperture 22 for a sewn length L extending from the structural connector 20 to the proximal tip 45. The webbing fabric 42 also has a padding 50 (depicted in FIG. 5) fixed to the second surface 42B, between the sewn end 44 and the sleeve end 46, and the webbing fabric 42 terminates at a distal tip 47 of the sleeve end 46. In the embodiment depicted in FIG. 5, the padding 50 is a rectangular strip of neoprene that is two inches wide and sixteen inches long. In other embodiments, the padding 50 is between one and four inches wide and is between twelve and twenty inches long. The distal tip 47 of the webbing fabric 42 is fixed to the second aperture 36 of the sleeve 30. The sleeve 30 surrounds the webbing fabric 42 between the padding 50 and the seam end 44. The sleeve 30 slides along the webbing fabric 42 to allow adjustment of the length of the webbing fabric 42 to a desired length for the fundamental movement patterns of the user. In one embodiment, the webbing fabric 42 is made from nylon but other materials do not depart from the present invention.

In the embodiment depicted in FIGS. 1 and 2, the sleeve 30 automatically slides along the webbing fabric 42 to a secured length during a securing period and the user manually slides the sleeve 30 along the webbing fabric 42 to the desired length during a preparation period. Friction forces between the sleeve 30 and the webbing fabric 42 maintains the desired length during an operation period when the user performs the fundamental movement patterns. In one embodiment, the desired length is longer than the secured length.

Figure 6:
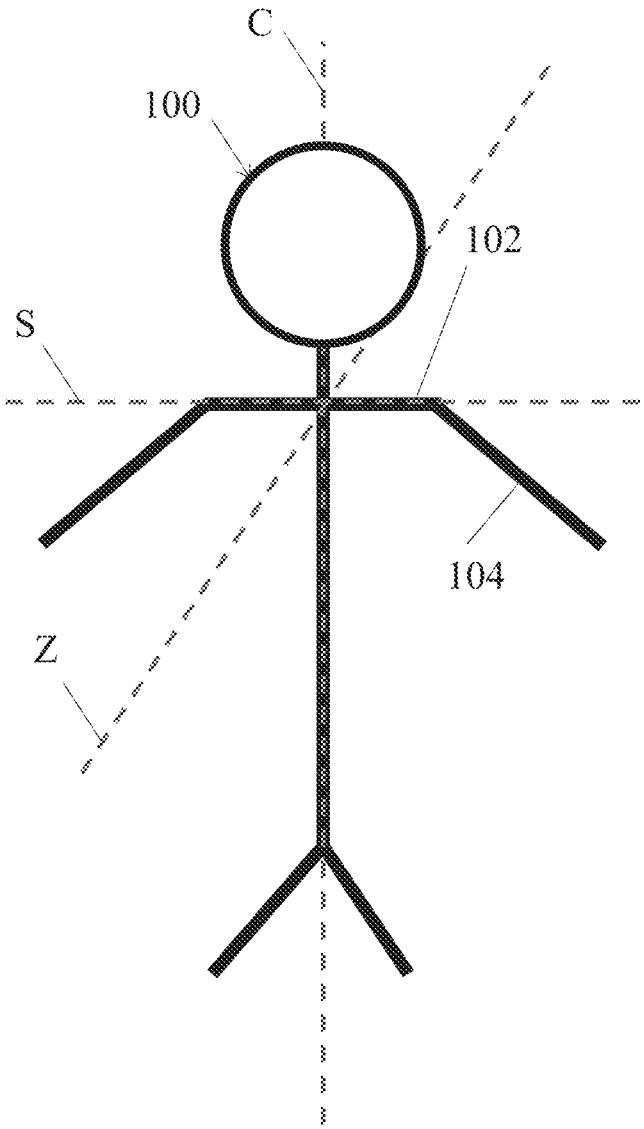
FIG. 6 is a schematic view of a user compatible with the cable attachment of FIG. 1.

The cable attachment 10 provides a resistance force the prevents the fundamental movement patterns of the user. An exemplary user 100 is depicted in FIG. 6. The fundamental movement patterns of the user 100 are total body rotational movements (i.e., rotation about a central axis C) and/or lateral movements (i.e., translation parallel to shoulder axis S or parallel to third axis Z). The fundamental movement patterns include but are not limited to movement in more than one plane of motion, squatting, lunging, rotation through the hips of the user and/or rotation through the trunk of the user.

Referring to FIGS. 2 and 6, a method of accommodating fundamental movement patterns of a user 100 is also disclosed herein. The method includes providing a cable attachment 10 (as depicted in FIG. 2) having a structural connector 20 defining a mounting aperture 22, a sleeve 30 forming a first aperture 34 and a second aperture 36 opposite the first aperture 34 and a webbing loop 40 reaching through the mounting aperture 22 and fixing to itself at a sewn end 44 and fixing to the second aperture 36 at an opposite sleeve end 46. The method includes attaching the mounting aperture 22 of the structural connector 20 to a structure (not depicted). The structure provides an external resistance to movement of the user 100. The method then includes lengthening the webbing loop 40 fully, as depicted in FIG. 2, with the user 100 facing away from the structure. Referring to FIG. 6, the user 100 then places an arm 104 through a portion of the webbing loop having a U-shaped cross-section (i.e., the portion proximate the padding 50 as depicted in FIG. 2) until the webbing loop 40 wraps around a shoulder 102. The method includes the user 100 then rotating in a direction away from the cable attachment 10 (about central axis C). Finally, the method includes performing fundamental movement patterns with the shoulder 102 and/or arm 104 of the user 100 in the portion of the webbing loop 40. The fundamental movement patterns include swinging, throwing, squatting and/or lunging.

The method also includes sliding the sleeve 30 along the webbing loop 40 away from the structural connector 20 before or after the step of performing fundamental movement patterns. The sleeve 30 slides along and engages the webbing loop 40 along an engaged length E of the loop to form a desired length of the webbing loop 40. The sleeve 30 automatically slides along the webbing loop 40 towards the user 100 (i.e., away from the structural connector 20) during the step of rotating the user in a direction away from the cable attachment 10. The sleeve 30 engages the webbing loop 40 along engaged length E after automatically sliding along the sleeve 30 to a secured length of the sleeve 30. In one embodiment, the sleeve 30 is made of a flexible material (e.g. neoprene, other synthetic rubbers, etc.). In some embodiments, engaged length E is greater than the width of webbing loop 40. In some embodiments, engaged length E is about three times greater than the width of webbing loop 40.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

As will be apparent to those skilled in the art, various modifications, adaptations and variations of the foregoing specific disclosure can be made without departing from the scope of the invention claimed herein. The various features and elements of the invention described herein may be combined in a manner different than the specific examples described or claimed herein without departing from the scope of the invention. In other words, any element or feature may be combined with any other element or feature in different embodiments, unless there is an obvious or inherent incompatibility between the two, or it is specifically excluded.

References in the specification to "one embodiment," "an embodiment," etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such aspect, feature, structure, or characteristic with other embodiments, whether or not explicitly described.

The singular forms "a," "an," and "the" include plural reference unless the context clearly dictates otherwise. Thus, for example, a reference to "a plant" includes a plurality of such plants. It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The term "and/or" means any one of the items, any combination of the items, or all of the items with which this term is associated. The phrase "one or more" is readily understood by one of skill in the art, particularly when read in context of its usage.

Each numerical or measured value in this specification is modified by the term "about". The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by the skilled artisan, all numbers, including those expressing quantities of reagents or ingredients, properties such as molecular weight, reaction conditions, and so forth, are approximations and are understood as being optionally modified in all instances by the term "about." These values can vary depending upon the desired properties sought to be obtained by those skilled in the art utilizing the teachings of the descriptions herein. It is also understood that such values inherently contain variability necessarily resulting from the standard deviations found in their respective testing measurements.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range (e.g., weight percents or carbon groups) includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio. Accordingly, specific values recited for radicals, substituents, and ranges, are for illustration only; they do not exclude other defined values or other values within defined ranges for radicals and substituents.

One skilled in the art will also readily recognize that where members are grouped together in a common manner, such as in a Markush group, the invention encompasses not only the entire group listed as a whole, but each member of the group individually and all possible subgroups of the main group. Additionally, for all purposes, the invention encompasses not only the main group, but also the main group absent one or more of the group members. The invention therefore envisages the explicit exclusion of any one or more of members of a recited group. Accordingly, provisos may apply to any of the disclosed categories or embodiments whereby any one or more of the recited elements, species, or embodiments, may be excluded from such categories or embodiments, for example, as used in an explicit negative limitation.

What is claimed is:

1. A cable attachment that accommodates fundamental movement patterns of a user, the cable attachment comprising:

a structural connector defining a mounting aperture therein;

a sleeve formed by a single section of a material wrapped around and fastened to itself forming a first aperture at a first end and a second aperture at an opposite second end; and a webbing loop comprising a webbing fabric having a first surface and a second surface opposite the first surface, the first surface and the second surface extending from a sewn end to a sleeve end, a proximal tip of the sewn end extending through the mounting aperture in the structural connector and the second surface of the webbing fabric is fixed to itself proximate the aperture for a sewn length extending from the structural connector to the proximal tip, the webbing fabric further comprising a padding fixed to the second surface between the sewn end and the sleeve end and the webbing fabric terminating at a distal tip of the sleeve end, wherein the distal tip of the webbing fabric is fixed to the second aperture of the sleeve and the sleeve surrounds the webbing fabric between the padding and the sewn end, and wherein the sleeve is slidingly engaged at an engaged length of the webbing fabric wherein the engaged length is a same length as an interface between the sleeve and the webbing fabric to allow adjustment of a length of the webbing fabric to a desired length to accommodate fundamental movement patterns of the user, wherein the engaged length is greater than a width of the webbing fabric.

2. The cable attachment of claim 1, wherein the sleeve automatically slides along the webbing fabric to a secured length during a securing period and the user manually slides the sleeve along the webbing fabric to the desired length during a preparation period.

3. The cable attachment of claim 1, wherein friction between the sleeve and the webbing fabric maintains the desired length during an operation period when the user performs the fundamental movement patterns.

4. The cable attachment of claim 2, wherein the desired length is longer than the secured length.

5. The cable attachment of claim 1, wherein the cable attachment provides a resistance force preventing the fundamental movement patterns of the user and the fundamental movement patterns of the user is at least one of a rotational movement and a lateral movement.

6. The cable attachment of claim 1, wherein the mounting aperture of the structural connector attaches to a fixed structure.

7. The cable attachment of claim 1, wherein the fundamental movement patterns of the user is movement in more than one plane of motion.

8. The cable attachment of claim 1, wherein the fundamental movement patterns of the user is at least one of squatting, lunging, rotation through hips of the user, rotation through trunk of the user and rotation through shoulders of the user.

9. The cable attachment of claim 1, wherein the engaged length is about three times greater than the width of the webbing fabric.

10. The cable attachment of claim 1, wherein the sleeve is composed of a rubber material.

11. The cable attachment of claim 10, wherein the padding is composed of a rubber material.

* * * * *